US009051682B2

(12) United States Patent
Allende

(10) Patent No.: US 9,051,682 B2
(45) Date of Patent: Jun. 9, 2015

(54) APPARATUS FOR USE IN LAUNDERING GARMENTS HAVING CUPS AND METHODS THEREFOR

(71) Applicant: Sandra Allende, Washington, NJ (US)

(72) Inventor: Sandra Allende, Washington, NJ (US)

( * ) Notice: Subject to any disclaimer, the term of this patent is extended or adjusted under 35 U.S.C. 154(b) by 219 days.

(21) Appl. No.: 13/657,493

(22) Filed: Oct. 22, 2012

(65) Prior Publication Data

US 2014/0109321 A1 Apr. 24, 2014

(51) Int. Cl.
*D06F 95/00* (2006.01)

(52) U.S. Cl.
CPC ..... *D06F 95/008* (2013.01)

(58) Field of Classification Search
None
See application file for complete search history.

(56) References Cited

U.S. PATENT DOCUMENTS 3,769,819 A * 11/1973 Contreras ..... 68/213
5,556,013 A 9/1996 Mayer
6,234,368 B1 5/2001 DesForges et al.
6,742,683 B1 6/2004 Phan
2008/0099518 A1 5/2008 Radtke et al.

FOREIGN PATENT DOCUMENTS

JP 2000-342890 A 12/2000

OTHER PUBLICATIONS

International Application No. PCT/US2013/066086, International Search Report & Written Opinion, 12 pages, Feb. 3, 2014.

* cited by examiner

*Primary Examiner* — Jason Ko
(74) *Attorney, Agent, or Firm* — Perkins Coie LLP

(57) ABSTRACT

An apparatus for use in laundering a garment having cups comprising a flexible panel, a pair of cup supports attached to the flexible panel, and a plurality of retainers attached to the flexible panel to hold each cup of the garment against a corresponding cup support. Each cup support comprises a convex member. Each cup support may include a plurality of apertures formed through the convex member. Each cup may further include a plurality of protrusions to space the cups of the garment away from the convex member. The apparatus includes a water permeable bag extending around the flexible panel. In this case, the flexible panel may be attached to the water permeable bag.

16 Claims, 8 Drawing Sheets

APPARATUS FOR USE IN LAUNDERING GARMENTS HAVING CUPS AND METHODS THEREFOR

BACKGROUND

Many women's garments include cups formed from a relatively stiff material in order to provide support and a smooth aesthetic appearance. Such garments include brassieres, or bras, lingerie, swimsuits, camisoles, tank tops, dresses, and other garments with built-in breast support. The cups of these garments are often formed of a fiberfill material or a molded foam pad, for example. These types of materials are relatively stiff in order to maintain their shape during normal use.

However, washing these garments in a machine tends to deteriorate the garment, particularly the cups. For example, the cups get crushed or otherwise deformed and the straps tangle with other items in the wash. Furthermore, a bra's clasps often snag on other items in the wash as well as the bra itself. As a result, the bra becomes distorted and damaged, no longer fitting correctly.

Machine washing a bra as few as 4 or 5 times is enough to deteriorate the cups. Wearing out a garment in such a short amount of time is frustrating, particularly when there is a connection to the garments color, fit, and style. Furthermore, bras and garments with breast supports are expensive. Replacing bras that cost approximately $60-70 each, and garments that can cost significantly more, after only 5 washings is impractical.

While conventional mesh garment bags may help prevent clasps from tangling with other items in the wash, conventional mesh garment bags do not protect cups against crushing and distortion. Furthermore, conventional products attempting to address these problems suffer the further disadvantage that they are not useable in a dryer. The only alternative is to hand wash and/or air-dry these types of garments, which is a time consuming and inconvenient endeavor.

Accordingly, there is a need for an apparatus for use in laundering garments having cups that prevents damage to the cups and prevents shoulders, back straps, and clasps from crushing, snagging, and tangling, and is washer and dryer safe.

SUMMARY

Provided herein is an apparatus for use in laundering a garment having cups. In an embodiment, the apparatus comprises a flexible panel, a pair of cup supports attached to the flexible panel, and a plurality of retainers, such as clips, attached to the flexible panel to hold each cup of the garment against a corresponding cup support. The apparatus may further comprise a pouch attached to the flexible panel that is adapted to receive a clasp of the garment.

In an aspect of the technology described herein, each cup support comprises a convex member. Each cup support may include a plurality of apertures formed through the convex member. Each cup support may further include a plurality of protrusions that space the cups of the garment away from the convex member.

In another aspect of the technology, the apparatus includes a water permeable bag extending around the flexible panel. In this case, the flexible panel may be attached to the water permeable bag.

In another embodiment, the apparatus comprises a first flexible panel having a surrounding edge margin and a second flexible panel attached to the first flexible panel along at least a portion of the edge margin defining an interior region therebetween. The first and second flexible panels may comprise water permeable material. A third flexible panel is disposed in the interior region and a pair of cup supports are attached to the third flexible panel. A plurality of retainers are disposed on the third flexible panel proximate the cup supports. The retainers hold each cup of the garment in close confronting relation with a corresponding cup support. In yet another aspect of the technology, the third flexible panel is rectangular and is attached only along one edge to the surrounding edge margin of the first flexible panel.

Also contemplated herein are methods of preparing a garment having cups for laundering. In an embodiment, the method comprises attaching the garment to a flexible panel, supporting the cups of the garment with a pair of cup supports attached to the panel, and enclosing the cup supports and at least a portion of the garment between two mesh panels. The method may further comprise inserting the flexible panel into the garment and adjacent the cups of the garment, and extending the garment beyond the two mesh panels. A method for laundering a garment having cups is also provided. In an embodiment, this method includes preparing the garment for laundering and then machine washing and machine drying the garment while the garment is attached to the flexible panel and enclosed between the mesh panels.

These and other aspects of the disclosed technology will be apparent after consideration of the Detailed Description and Figures herein. It is to be understood, however, that the scope of the invention shall be determined by the claims as issued and not by whether given subject matter addresses any or all issues noted in the background or includes any features or aspects recited in this summary.

BRIEF DESCRIPTION OF THE DRAWINGS

Non-limiting and non-exhaustive embodiments of the apparatus, including the preferred embodiment, are described with reference to the following figures, wherein like reference numerals refer to like parts throughout the various view unless otherwise specified.

DETAILED DESCRIPTION

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense.

Provided herein is an apparatus for use in laundering a garment having cups. The apparatus is designed to help keep the cups, straps, foam, underwire and hooks of the undergarment from pulling, stretching, ringing, and otherwise becoming distorted. The apparatus lifts the garment cups slightly off the dome shape, so that water, detergent and air make contact with the garment allowing it to be cleansed and dried thoroughly, while protecting the shape and form of the cup and the fabric. The apparatus also protects the straps and hooks from catching on other clothes in the washer and dryer, thus helping to eliminate wringing of the garment.

Figure 1:
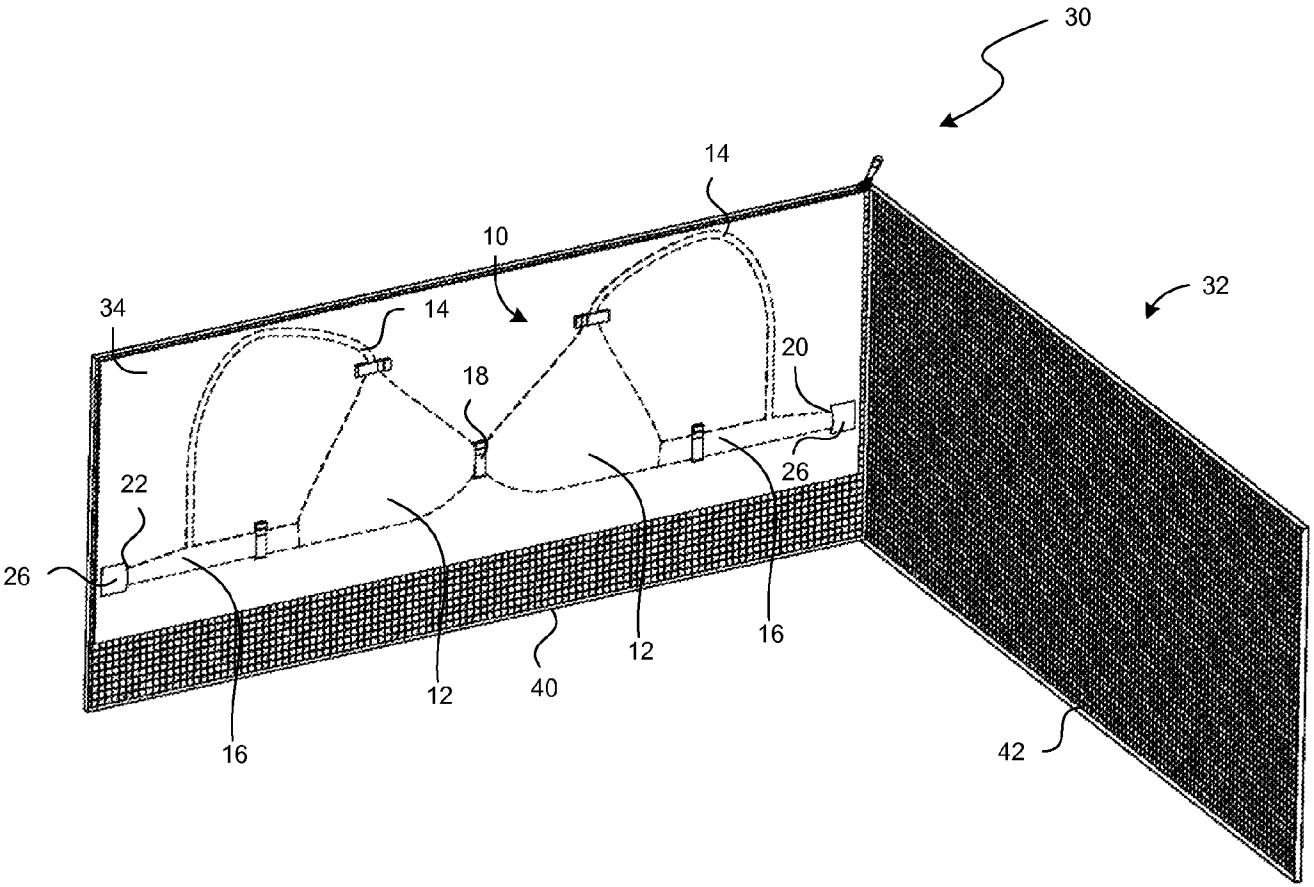
FIG. 1 is a perspective view of an apparatus for use in laundering a garment having cups according to a first exemplary embodiment.
Figure 2:
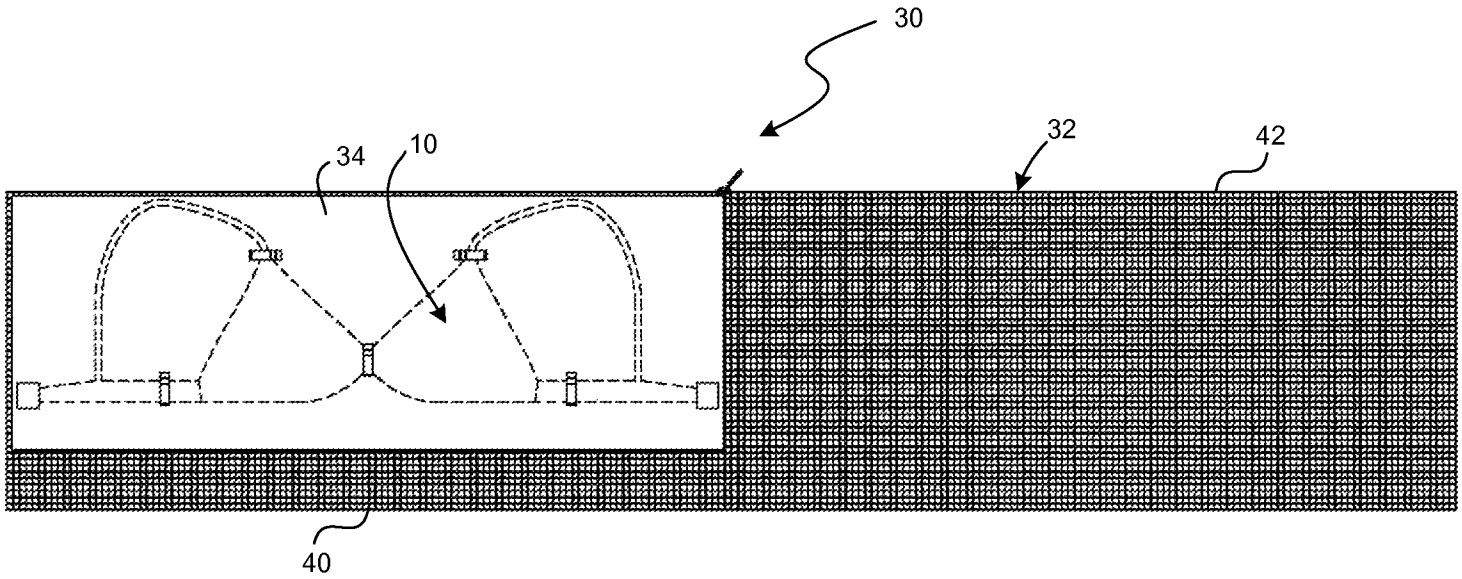
FIG. 2 is a top plan view of the apparatus shown in FIG. 1 with a representative garment installed in the apparatus.
Figure 3:
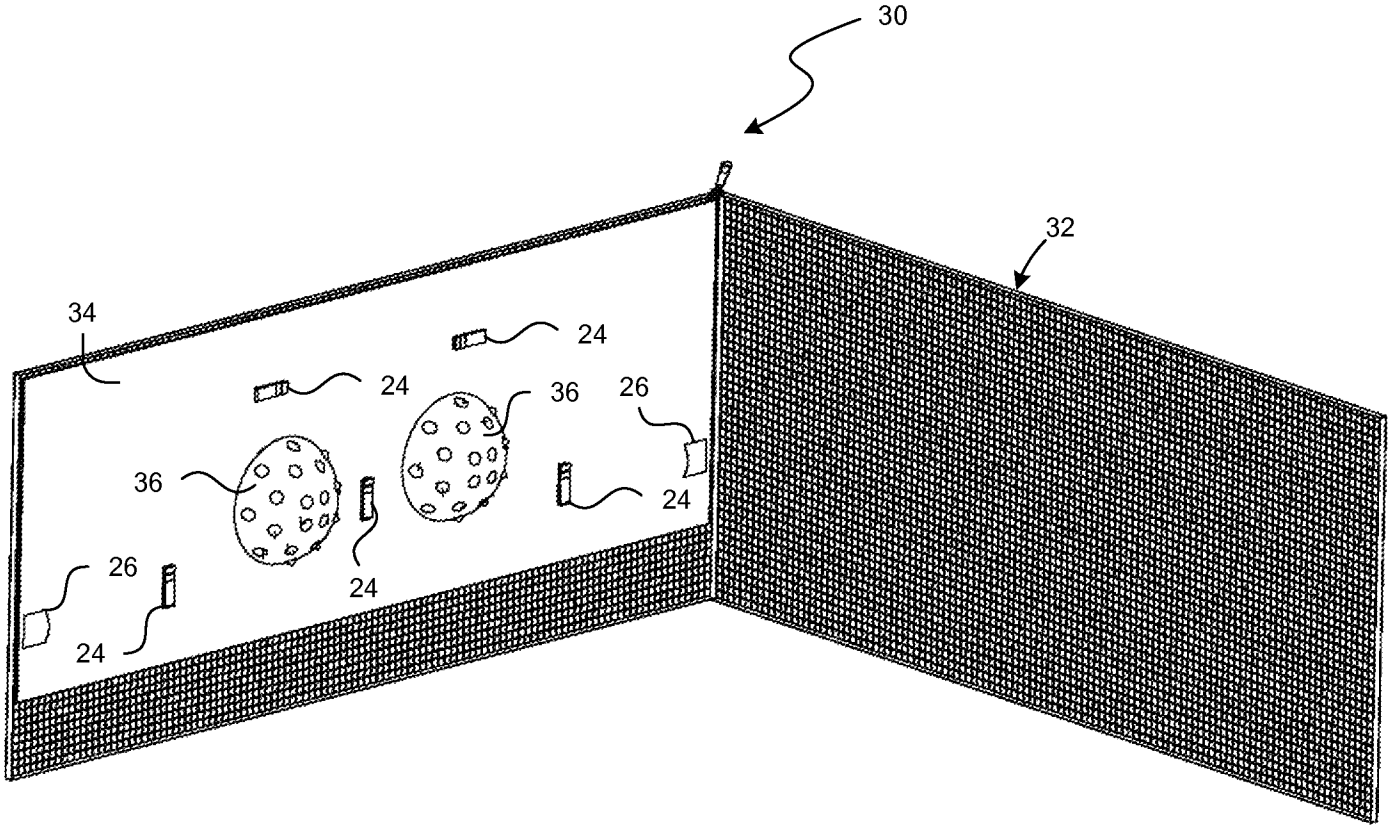
FIG. 3 is a perspective view of the apparatus shown in FIGS. 1 and 2 with the representative garment removed to illustrate the cup support members.

With reference to FIGS. 1 and 2, apparatus 30 is used in laundering a garment having cups, such as bra 10. Apparatus 30 includes a water-permeable bag 32 with a flexible panel 34 disposed therein. Water permeable bag 32 includes first and second flexible panels 40 and 42, respectively. With further reference to FIG. 3, flexible panel 34 includes a plurality of retainers 24 and a pair of cup supports 36. In this case, retainers 24 are in the form of clips which are operative to engage the bra.

As is known in the art, bra 10 may include a pair of cups 12 which are interconnected by gore 18. Extending from each cup 12 is a back wing strap 16 each of which terminates in a corresponding clasp 20, 22. Straps 14 extend from the top of each cup 12 and connect with a corresponding back wing 16.

Figure 5:
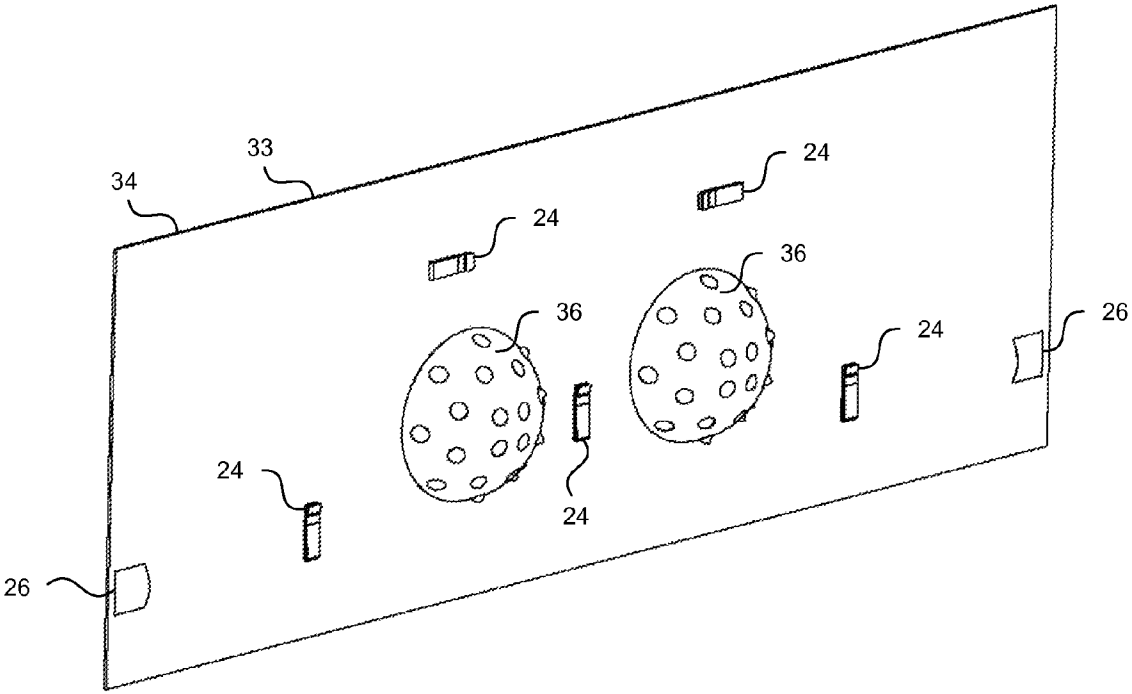
FIG. 5 is a perspective view of the flexible panel and associated clips and cup supports as shown in FIGS. 1-3.

In this case, the retainers 24 engage bra 10 at the gore 18, both back wings 16, and at the top of the cups 12 where each strap 14 extends. It should be understood that the location and construction of the retainers are for illustrative purposes only. Other retainers, in the form of clips, straps, pockets, pouches, snaps, buttons, and the like, may be used and their locations may vary. In this embodiment, a pair of pouches 26 are attached to flexible panel 34 which are sized and configured to receive clasps 20 and 22. As shown in FIG. 5, a pair of cup supports 36 are attached to flexible panel 34. It can be appreciated that the plurality of retainers 24 are disposed proximate the cup supports 36 and are thereby operative to hold each cup 12 of the garment in close confronting relation with a corresponding cup support 36. The retainers 24 and cup supports 36 may be attached to the flexible panel 34 by sewing, gluing, welding (in the case of plastic components), or through suitable fasteners such as snaps or cooperative hook and loop material, for example.

While the exemplary embodiments of the apparatus are described herein with respect to a bra, it should be understood that other garments having cups may be laundered using the disclosed apparatus. Garments having cups include, for example and without limitation, lingerie, swimsuits, camisoles, tank tops, dresses, training bras, full cup bras, demi cup bras, padded bras, underwired bras, strapless bras, convertible bras, t-shirt bras, minimizer bras, maximizer/push up bras, sports bras, built-in bras, shelf bras, peephole bras, maternity bras, and mastectomy bras, as well as other garments with built-in breast support.

Figure 4:
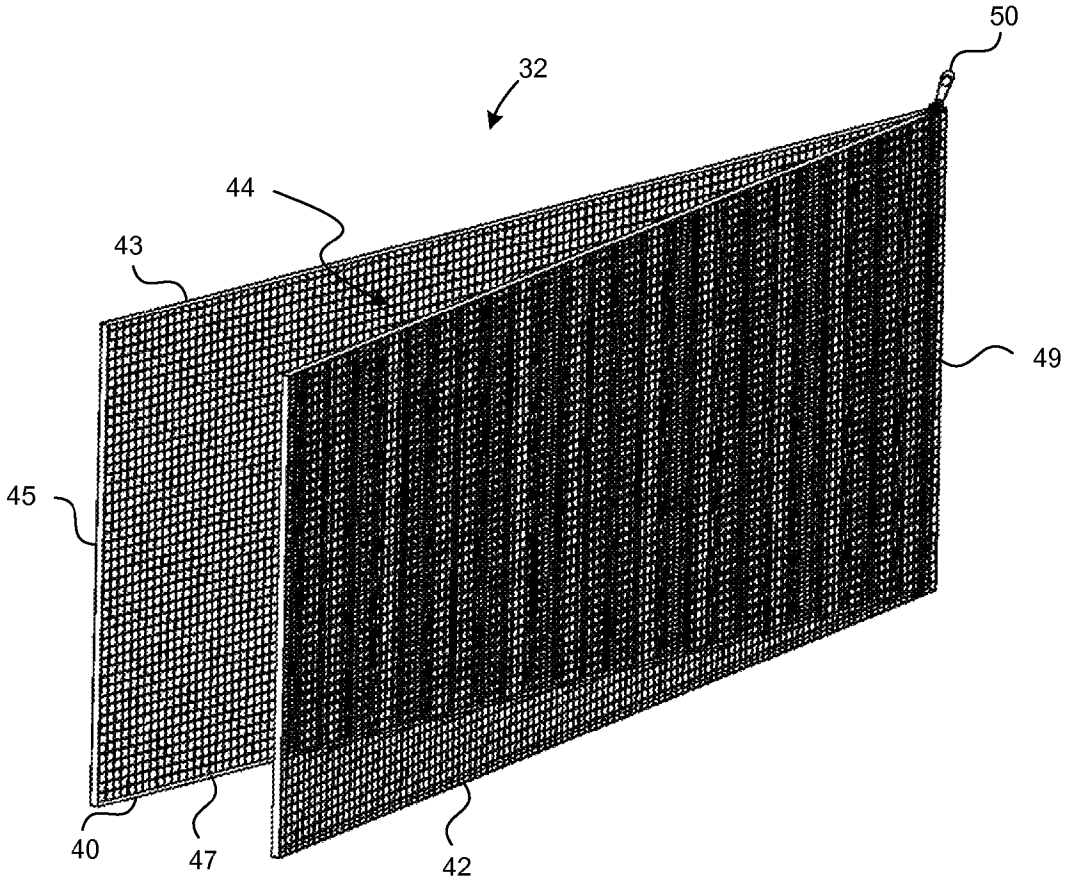
FIG. 4 is a perspective view of a water-permeable bag.

Referring now to FIG. 4, water-permeable bag 32 includes a first flexible panel 40 and a second flexible panel 42. First flexible panel 40 has a surrounding edge margin defined by edges 43, 45, 47, and 49. In this case, second flexible panel 42 is attached to first flexible panel 40 along the edge 49. The panels may be attached by sewing, for example. In other cases, the panels may be attached or connected together with a zipper, snaps, buttons, or cooperative hook and loop materials. While the flexible bag 32 is described here as two separate panels connected together at edge 49, it should be appreciated that the bag may be comprised of a single piece of material folded over to form a bag. In such a case, the second panel is effectively attached to the first panel at the fold. Bag 32 is comprised of water-permeable material, such as polyester mesh, for example.

In this embodiment, a zipper 50 extends along edge margin 43 and 45. When the zipper is engaged it completes the bag, defining an interior region 44 between the first and second panels 40, 42. The bag 32 surrounds and protects the garment disposed in the interior region 44. Although the edge margins 43, 45 are closed by zipper 50 in this example, the bag may be closed by snaps, buttons, or cooperative hook and loop material, to name a few. It should be appreciated that because zipper 50 only extends along edges 43 and 45 the bottom edge 47 remains open. The opening along edge 47 allows longer garments to be placed inside the apparatus for laundering, such as dresses, lingerie, tank tops, etc.

Figure 6:
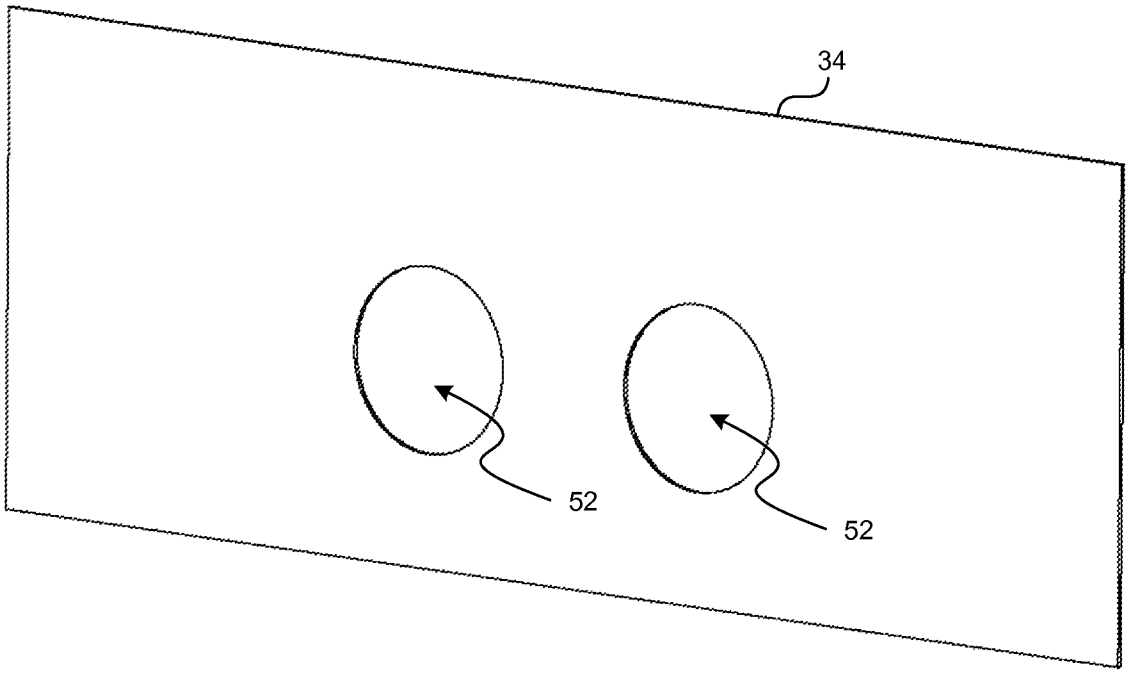
FIG. 6 is a perspective view of the flexible panel as shown in FIG. 5 as viewed from the back side.

With reference to FIG. 6 it can be seen that flexible panel 34 includes a pair of openings 52 corresponding with the back side of cup supports 36. It should be appreciated that cup supports 36 may be hollow, as shown here, and openings 52 prevent any water present during the laundering process from becoming trapped between cup supports 36 and flexible panel 34.

Figure 7:
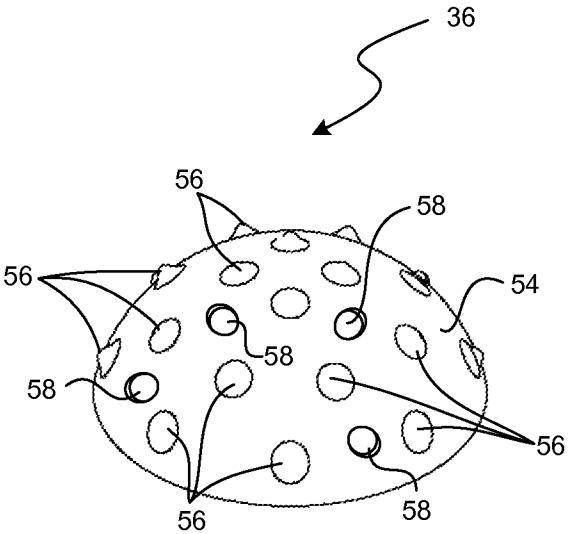
FIG. 7 is a perspective view of a cup support as shown in the figures.

FIG. 7 illustrates cup support 36 which includes a convex member 54 and a plurality of protrusions 56. Protrusions 56 are operative to space the cups 12 of the garment 10 away from the convex member 54 thereby allowing fluid and airflow around the cup to facilitate cleaning and drying. As shown in this case, the convex member 54 may also include a plurality of apertures 58 formed through the convex member. Apertures 58 may be included to further facilitate air and water flow during the laundering process. As shown in this embodiment cup support 36 is a hollow convex shaped component. However, cup support 36 may be constructed as a solid piece of material, as a lattice structure or cage, or other convex structure. Cup support 36 may be molded or thermoformed, for example, from any suitable material such as plastic or rubber to name a few. It should be appreciated that cup supports 36 may be different sizes corresponding to various bra cup sizes. In addition, the cup supports 36 may be interchangeable between different sizes. In an embodiment, the cups are stacked smallest to largest and are removable and replaceable, thereby facilitating the selection of the appropriate sized cup support 36.

Figure 8:
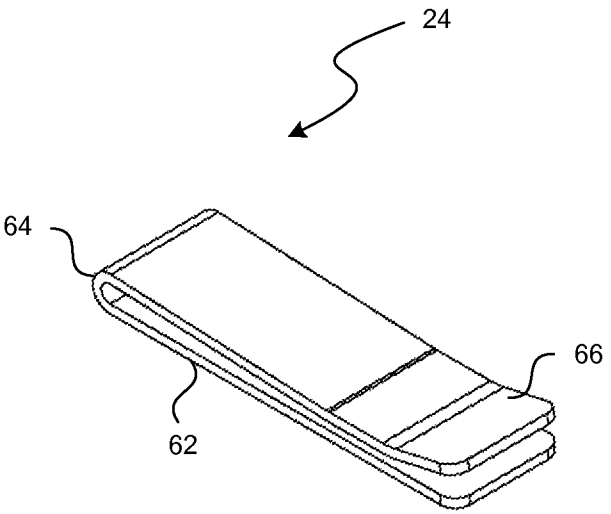
FIG. 8 is a perspective view of a representative retainer as shown in the figures.

FIG. 8 illustrates a retainer 24 in the form of a clip having a base portion 62 and a clip portion 66 which interconnects to the base portion 62 via arcuate portion 64. The clip may be formed of plastic such as ABS, or the like. As mentioned above, the clips may be attached to the flexible panel 34 by sewing, gluing, welding (in the case of plastic components), or through suitable fasteners such as snaps or cooperative hook and loop material, for example.

Also contemplated herein are methods of preparing a garment having cups for laundering. The method may include attaching the garment to a flexible panel 34 and supporting the cups of the garment with a pair of cup supports such as cup supports 36. The method further includes enclosing the cup supports 36 and at least a portion of the garment between two mesh panels such as panels 40 and 42. In the case of a dress, for example, the method may further comprise inserting the flexible panel 34 into the garment and adjacent the cups of the garment such that cup supports 36 engage and support the cups of the garment. Also in the case of an elongate garment, such as a dress, the method may further comprise extending the garment beyond the two mesh panels 40 and 42. In this case, beyond panels 40 and 42 across edge 47. A method for laundering a garment having cups is also provided. In an embodiment, this method includes preparing the garment for laundering, as described above, and then machine washing and machine drying the garment while the garment is attached to the flexible panel and enclosed between the mesh panels.

Accordingly, the apparatus for use in laundering a garment having cups and methods therefor have been described with some degree of particularity directed to the exemplary embodiments. It should be appreciated, however, that the present invention is defined by the following claims construed in light of the prior art so that modifications or changes may be made to the exemplary embodiments without departing from the inventive concepts contained herein.

What is claimed is:

1. An apparatus for use in laundering a garment having cups, the apparatus comprising:

a first flexible panel having a surrounding edge margin;

a second flexible panel attached to the first flexible panel along at least a portion of the edge margin defining an interior region therebetween;

a third flexible panel disposed in the interior region, wherein the third flexible panel is rectangular and is attached only along one edge to the surrounding edge margin;

a pair of cup supports attached to the third flexible panel; and a plurality of retainers disposed on the third flexible panel proximate the cup supports and operative to hold each cup of the garment in close confronting relation with a corresponding cup support.

2. The apparatus according to claim 1, wherein each cup support comprises a convex member.

3. The apparatus according to claim 2, wherein each cup support includes a plurality of apertures formed through the convex member.

4. The apparatus according to claim 1, wherein the first and second flexible panels comprise water permeable material.

5. The apparatus according to claim 1, further comprising at least one pouch attached to the third flexible panel and adapted to receive a clasp of the garment.

6. The apparatus according to claim 1, wherein the plurality of retainers includes at least one clip.

7. An apparatus for use in laundering a garment having cups, the apparatus comprising:

a first flexible panel having a surrounding edge margin;

a second flexible panel attached to the first flexible panel along at least a portion of the edge margin defining an interior region therebetween;

a third flexible panel disposed in the interior region;

a pair of cup supports attached to the third flexible panel, wherein each cup support comprises a convex member including a plurality of apertures formed through the convex member and a plurality of protrusions operative to space the cups of the garment away from the convex member; and a plurality of retainers disposed on the third flexible panel proximate the cup supports and operative to hold each cup of the garment in close confronting relation with a corresponding cup support.

8. The apparatus according to claim 7, wherein the first and second flexible panels comprise water permeable material.

9. The apparatus according to claim 7, further comprising at least one pouch attached to the flexible panel and adapted to receive a clasp of the garment.

10. The apparatus according to claim 7, wherein the plurality of retainers includes at least one clip.

11. The apparatus according to claim 7, wherein the third flexible panel is rectangular and is attached only along one edge to the surrounding edge margin.

12. An apparatus for use in laundering a garment having cups, the apparatus comprising:

a first flexible panel having a surrounding edge margin;

a second flexible panel attached to the first flexible panel along at least a portion of the edge margin defining an interior region therebetween;

a third flexible panel disposed in the interior region;

a pair of cup supports attached to the third flexible panel, wherein each cup support comprises a convex member including a plurality of apertures formed through the convex member and a plurality of protrusions operative to space the cups of the garment away from the convex member; and at least one retainer positioned proximate each convex member and operative to hold each cup of the garment in close confronting relation with a corresponding cup support.

13. The apparatus according to claim 12, wherein the first and second flexible panels comprise water permeable material.

14. The apparatus according to claim 12, further comprising at least one pouch attached to the flexible panel and adapted to receive a clasp of the garment.

15. The apparatus according to claim 12, wherein the at least one retainer includes at least one clip.

16. The apparatus according to claim 12, wherein the third flexible panel is rectangular and is attached only along one edge to the surrounding edge margin.

* * * * *